United States Patent [19]

Holmes et al.

[11] 3,958,523

[45] May 25, 1976

[54] SAIL HOISTING, SUPPORTING AND FURLING APPARATUS

[75] Inventors: Tracy S. Holmes, Santa Monica; Thomas J. Simms, Jr., Long Beach, both of Calif.

[73] Assignee: Tracy Holmes Corporation, Santa Monica, Calif.

[22] Filed: May 30, 1975

[21] Appl. No.: 582,082

[52] U.S. Cl. ..... 114/106; 114/105

[51] Int. Cl.[2] ..... B63H 9/04

[58] Field of Search ..... 114/102, 104, 105, 106, 114/107, 108, 39

[56] References Cited

UNITED STATES PATENTS

| | | | |
|---|---|---|---|
| 3,602,180 | 8/1971 | Holmes | 114/107 |
| 3,611,969 | 10/1971 | Hood | 114/106 |
| 3,851,610 | 12/1974 | Greene | 114/106 |

*Primary Examiner*—Trygve M. Blix
*Assistant Examiner*—Stuart M. Goldstein
*Attorney, Agent, or Firm*—Fulwider, Patton, Rieber, Lee & Utecht

[57] ABSTRACT

A sailboat forestay or headstay assembly for hoisting, supporting and furling a jib, including a roller furling unit, a wire secured at its lower end to this unit and at its upper end to a swivel unit, and a furling-drive connection adjacent the upper end of the wire comprising a hexagonal rod attached to the wire as an extension thereof, and a hoisting element having a polygonal through passage which slides freely along the wire and snugly and non-rotatably onto the rod, to couple the sail to the wire for furling as the wire is rotated. Hoisting and sail-supporting connections in the form of bails are centrally pivoted on a rotary sleeve of the hoisting element, and the lower end of the rod is tapered polygonally, with a cylindrical section below, to align the sleeve with the rod during hoisting.

18 Claims, 3 Drawing Figures

14
28
27
29
32
31
30
2
33
45
53
34
47
49
2
41
10
44
60
40
60a
60b
39
43
38
13
35
11
22
21
42
37
19
15
20
24
18
23
17
25
58
45
52
48a
48b
53
50
54
54
49
50
51
47
48
55
55
3
3
41
44
α
59
44
57
47
59

SAIL HOISTING, SUPPORTING AND FURLING APPARATUS

BACKGROUND OF THE INVENTION

This invention relates to sailboat riggings and fittings, and relates more particularly to apparatus for hoisting, supporting and furling the sails of sailboats, most typically headstay and forestay assemblies for jibs and other headsails.

For many years, jibs and other headsails have been furled by rolling them around the elongated elements that support and stiffen the lead edges, or "luffs" of the sails. These elements may take various forms including cables, rods and the like, and are referred to in the trade and herein as "luff wires." Furling is primarily a matter of convenience, but also used to adjust the amount of active sail by rolling up, or "reefing," part of the sail.

To facilitate furling and unfurling of sails, roller-furling gear has been developed to connect the luff wire to the hull of the sailboat, and to rotate the luff wire in one direction when the sail is to be furled. The roller-furling gear also controls rotation of the wire in the opposite direction as a sail is unfurled. A typical roller-furling unit includes a drum that is wrapped with a control line for turning the drum, and thus the luff wire, to wrap the sail about the wire. The sail is set by releasing the control line and hauling on a line connected to the sail, typically a so-called "jibsheet," to unroll the sail from the luff wire as the control line is rolled up on the drum.

It will be evident, of course, that the luff of the sail must be attached to the luff wire so that the luff wire takes the luff with it as it rotates, rather than rotating relative to the sail. Since jibs conventionally have been attached by fasteners comprising loose, latching hooks, called "hanks" or "jib snaps," for connecting the jibs releasable and slidably to the luff wires, it has not been practical to use such conventional fasteners with furling gear. Instead, the customary practice has been to sew the jibs tightly and permanently onto the luff wires, thereby providing the necessary tightness for furling.

It is desirable in many situations to substitute one jib for another, to suit different sailing conditions, and for this purpose, non-furling riggings frequently have included a line, such as a jib halyard trained over a halyard block supported adjacent the upper ends of the luff wire, as permitted by the loose connection of the jib snaps on the luff wire. Of course, with a jib tightly sewn onto the luff wire so as to permit furling, the option of freely changing jibs is eliminated.

Efforts have been made to provide a suitable furling connection between the luff wire and the luff, that would permit hoisting and lowering of the sail, and also changing of sails, but these efforts have not resulted in a satisfactory solution. One prior development utilized a double wire with connections for rotating the two strands about a common longitudinal axis, with a hoisting connection that was slidable along the wires and rotatable thereby. This type of furling gear was relatively complex and bulky in construction, and although the substantial advance, was not an optimum solution. The primary objective of this invention is to provide a significant improvement and simplification of this general concept, to eliminate the need for more than a single wire, while providing a sail hoisting, supporting and furling apparatus with all of the advantages in hoisting and sail-changing available with prior non-furling riggings.

SUMMARY OF THE INVENTION

The present invention contemplates an improved sail hoisting, supporting and furling apparatus in which a hoisting element is fitted over the wire with a loose, sliding fit, to be raised and lowered freely along the wire, and a furling-drive element is affixed to the wire in a preselected position to enter the hoisting element as the latter is raised into its normal, raised position. The hoisting element has a non-circular outside surface that is sized and shaped to fit into the hoisting element with a snug sliding fit, thereby to couple the hoisting element to the wire for rotation therewith.

With this arrangement, the upper and lower ends of any conventional sail can be attached to the headstay element with conventional snap fasteners, and conventional jib snaps can be used to attach the sail at vertically spaced points to the wire, also in a conventional manner. The lower snap fastener connects the luff to the furling unit, for rotation by the drum, and the upper snap fastener connects the luff to the hoisting element. Thus, as the lower end of the wire is rotated by the furling unit, the lower fastener starts winding the lower end portion of the luff around the wire, and torsional force is transmitted through the wire to the furling-drive element, and thus to the hoisting element, which rotates the upper fastener to start the upper end portion of the luff around the wire. Although the wire can turn in the jib snaps, the intermediate portion of the luff follows the two end portions, and the entire sail is furled on the wire.

More specifically, as illustrated in the preferred embodiment shown herein, the hoisting element is a sleeve having an internal passage of regular polygonal cross-section, and the furling-drive element is a rod that is affixed to the upper end of the luff wire, and has an outside surface of regular polygonal cross-section sized to slide snugly into the sleeve. To facilitate entry and angular alignment, the lower end portion of the rod is downwardly tapered, and also is polygonal in cross-section, with a cylindrical section below having a rounded lower end. Preferably, the sleeve has 12 V-shaped internal grooves, to minimize the angular change necessary in alignment, and the rod preferably is six-sided, to fit in the sleeve as a nut fits in a wrench socket.

The hoisting sleeve has a sail-supporting connection on its lower portion, herein a bail with legs straddling the sleeve and pivotable about a transverse axis through the centerline of the passage through the sleeve. The hoisting-line or halyard connection on the hoisting sleeve comprises a second sleeve rotatably mounted around the upper end portion of the hoisting sleeve, and a second bail with legs straddling the second sleeve and pivotable about a second axis through the centerline of the passage.

These connections provide a swivel connection for the hoisting line, which holds the hoisting sleeve in the raised position while permitting the sleeve to turn as the sail is furled about the wire. These connections also apply to forces of the halyard and the sail to the hoisting sleeve in the most advantageous manner to minimize the tendency to tilt, and providing relatively free movement of the sleeve along the wire. In other respects, basically conventional fittings may be used, including a lower roller-furling unit and an upper swivel, above the furling-drive element.

Other aspects and advantages of the invention will become apparent from the following detailed description, taken in conjunction with the accompanying drawings.

DETAILED DESCRIPTION

Figures 1, 2, 3:
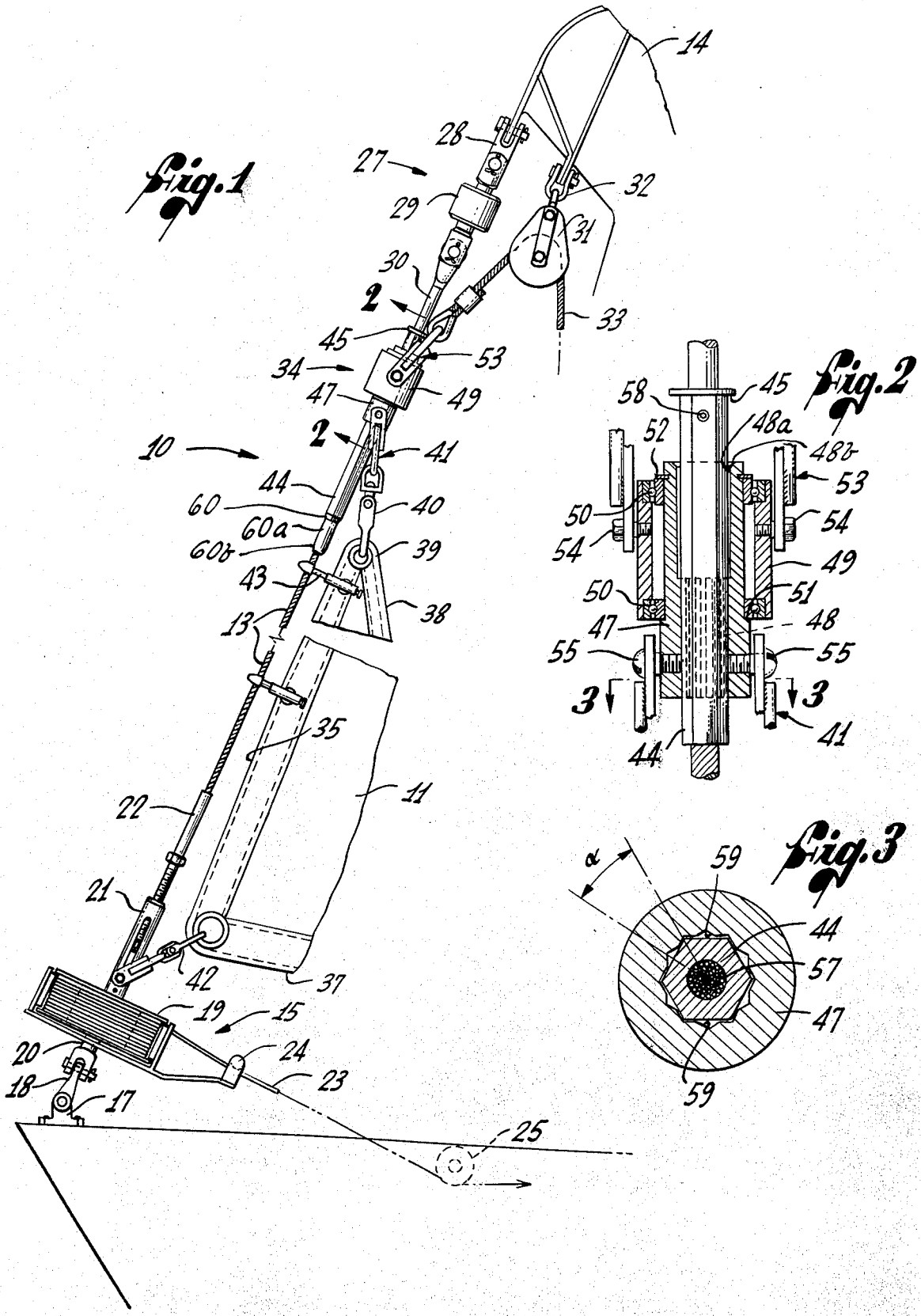
FIG. 1 is a fragmentary side elevational view showing a sail hoisting, supporting and furling apparatus in the form of a headstray or forestay assembly embodying the novel features of the present invention, with a roller-furling unit mounted between the foredeck of an illustrative sailboat hull and the masthead of the sailboat, a central portion of the view being removed for compactness of illustration.
FIG. 2 is an enlarged fragmentary cross-sectional view taken substantially along line 2—2 of FIG. 1.
FIG. 3 is an enlarged fragmentary cross-sectional view taken substantially along line 3—3 of FIG. 2.

As shown in the drawings for purposes of illustration, the invention is embodied in a roller-furling apparatus, indicated generally by the reference number 10, for supporting a jib 11 of a sailboat on a wire 13, and for furling the jib on the wire. This wire is a length of relatively heavy cable that is stretched between the foredeck of the sailboat and a masthead 14 spaced above, and somewhat toward the stern (not shown) from, the foredeck of the boat.

In general, the apparatus 10 includes a lower mounting assembly 15 in the form of a roller-furling unit that is attached to a fitting 17 on the foredeck, and includes, for example, a toggle 18, an open drum 19 rotatably supported on an axle 20 secured to the foredeck by the toggle, and a connector 21 in the form of a rod that secures the wire 13 to the drum for rotation therewith. Although the connection between the rod 21 and the wire can take other forms, such as a turnbuckle (not shown), herein it comprises an elongated rod 22 that is securely attached to the lower end of the wire and threaded releasably into the rod 21, for adjustment of length.

A control line 23 is wrapped around the drum 19, and its free end portion coming off the drum extends through a guide 24, past a block 25, and on along the hull, typically to the cockpit (not shown) of the boat. From the cockpit, this line controls the movement of the drum, and thus controls the furling and unfurling of the jib 11.

At the upper end of the wire 13 is an upper mounting 27 comprising a toggle 28 bolted to the masthead 14 and carrying an upper swivel unit 29 permitting the wire to rotate about its longitudinal axis. A swaged fitting is pinned at its upper end to the swivel unit and is joined at its lower end to the upper end of the wire. A typical halyard block 31 is suspended on a shackle 32 from the masthead 14 and a jib halyard 33 extends over a block from the deck area and down from the block to a hoisting element 34.

The jib 11 has a leading edge 35, or "luff" (typically with a wire or rope sewn in) that extends along the wire 13 in closely spaced relation therewith, a lower edge 37, or "foot," spaced above the foredeck, and a trailing edge 38, or "leach." The upper end 39 or "head" of the jib, is connected to the hoisting element 34 by a snap shackle 40 that is coupled to a U-shaped bail 41 on the hoisting element. The lower end or "tack" of the jib is similarly connected to the rod 21 of the furling unit 15 by a snap shackle 42 pivotally connected to the rod. Between the two snap shackles 40 and 42, a plurality of jib snaps 43 connect the luff 35 to the wire 13, only two such jib snaps being shown in FIG. 1.

Connected to the upper end of the wire 13, as an extension thereof, is a furling-drive element 44 which extends through the hoisting element 34 and has an abutment 45 above the hoisting element for limiting upward movement of the hoisting element. This abutment may be a simple stop washer fastened to the upper end of the furling-drive element, as shown most clearly in FIG. 2.

The hoisting element 34 comprises an elongated sleeve 47 having a through passage 48 that is non-circular in cross-section along at least a substantial part of its length. Herein, approximately the lower half is non-circular, as shown in FIG. 2, and specifically is of regular polygonal cross-section, preferably formed by 12 V-shaped grooves as shown in FIG. 3, resembling a wrench socket. The upper end portion 48$^a$ of the passage may be simply circular in cross-section, to fit around the element 44 with clearance, and has a small internal radius 48$^b$ at its upper end.

Fitted around the upper end portion of the hoisting sleeve 34 is a second sleeve 49 that is rotatably supported on the hoisting sleeve by antifriction thrust bearings 50 abutting against an external shoulder 51 in the mid-portion of the hoisting sleeve and held thereon by a snap ring 52 above the second sleeve, which thus is mounted for free rotation relative to the hoisting sleeve. A U-shaped bail 53, with legs straddling the second sleeve (see FIG. 2), is centrally hinged thereon, by bolts 54 on opposite sides, these bolts defining a pivotal axis that preferably extends through the centerline of the passage 48, through the hoisting sleeve.

The sail-supporting bail 41 is mounted with its legs straddling the exposed lower portion of the hoisting sleeve 35 and hinged thereto by screws 55 threaded into the opposite sides of this sleeve. These screws define a second pivotal axis that extends through the centerline of the passage 48. The two hinges apply the load forces from the jib halyard 33 and the head 39 of the jib 11 along the center of the hoisting element 34, and reduce the tendency to twist the element relative to the wire 13.

As shown most clearly in FIGS. 1 and 3, the furling-drive element 44 is an elongated rod having a longitudinal bore 57 through which the wire 13 extends, the wire being securely held in the bore, for example, by several set screws 58 (one being shown in FIG. 2) and an epoxy adhesive. The swaged fitting 30 is secured to the wire 13 and thus connects the wire to the swivel unit 29.

Herein, the rod 44 constituting the furling-drive element is of regular hexagonal cross-section, shown most clearly in FIG. 3, to fit in the passage 48 as a nut fits a socket wrench, the V-shaped corners of the rod being seated snugly in alternating grooves 59 (FIG. 3) around the passage. The two elements could be made of the same cross-sectional shape, of course (for example, both hexagonal), but the addition of an extra set of grooves in the passage enables the sleeve 47 to become angularly aligned with the rod with a reduced amount of turning.

To facilitate both lateral and angular alignment of the elements 34 and 44 as the element 34 is hoisted along the wire 13, the lower end portion of the rod is tapered downwardly, as indicated at 60, to cam the sleeve into coaxial relation and lateral alignment with the rod.

Angular alignment is accomplished by making the tapered portion of the same polygonal cross-section as the upper portion, but of progressively changing size, and a cylindrical section 60$^a$ is provided below the taper, with a rounded lower end 60$^b$ for cooperating with the radius 48$^b$ to facilitate axial alignment when hoisting.

The rod should be substantially longer than the hoisting sleeve 47, to receive the latter in different longitudinal positions determined by the position of the sleeve when the luff 35 becomes taut. The stop washer 45 serves merely as a safety limit on hoisting of the element 34.

Specific constructional and operational details will be apparent from the foregoing to those skilled in the art. A suitable wire will depend upon the type and size of the boat, and may be a rod instead of the cable shown, relatively heavy cables typically being used with furling gear (both conventional and in accordance with the present invention) to transmit torsional force from the drum 19 to the rod 44. The threaded connection between the rods 21 and 22, with a nut head 22$^a$ on the latter, permits separation of the wire 13 for assembly and removal of the hoisting element. One suitable rod for use as the furling-drive element 44 is a 10-inch section of hexagonal aluminum. Apart from the rod and the hoisting element 34, conventional parts may be used.

From the foregoing, it will be seen that the present invention provides a furling headstay assembly 10 with which a conventional sail 11 can be hoisted, supported in use, and readily changed or removed, all in a manner that has been conventional with non-furling headstays. At the same time, a conventional sail also can be furled on this headstay assembly in a manner that previously was limited to sails attached to their luff wires so as to prevent conventional hoisting and easy sail-changing.

These important additional functions have been incorporated in the assembly in a relatively simple and inexpensive manner that permits the use of a conventional roller-furling unit 15, a conventional wire 13 (except for the rod 44), and a conventional swivel unit 29 and other associated parts. In short, the assembly of the invention constitutes a substantial improvement over piror forestay assembly, with many significant advantages.

It will also be apparent that, while one specific embodiment of the invention has been shown and described, various modifications and changes may be made within the spirit and scope of the invention.

We claim:

1. In a sail hoisting, supporting and furling apparatus mountable on a sailboat having a hull and a mast, to extend between such hull and mast, and including an elongated wire having upper and lower ends and capable of transmitting torsional force from the lower end to the upper end, upper mounting means including a swivel unit for connecting said upper end to the mast, said-hoisting means, and lower mounting means including a drive member rotatably mounted on said hull and non-rotatably connected to said lower end for turning said wire about its longitudinal axis as said drive member is rotated relative to said hull, the improvement which comprises:

a hoisting element including a hoisting sleeve having a through passage fitted on said wire with a loose, clearance fit for movement longitudinally along said wire, said passage having a wall formed by a plurality of V-shaped inwardly opening grooves;

hoisting-line and sail-supporting connections mounted on said hoisting element to pivot about axes extending through the centerline of said passage;

a furling-drive element affixed to the upper end portion of said wire as an extension thereof, below said upper mounting means, and having a regular polygonal outside surface sized and shaped to receive said hoisting sleeve over said outside surface with a close sliding, and non-rotatably fit, thereby to couple said hoisting sleeve to said wire for rotation therewith;

said furling-drive element having a downwardly tapering lower end portion of the same polygonal shape for guiding said hoisting sleeve onto said furling-drive element and orienting the sleeve angularly for snug sliding engagement with the furling-drive element;

and means for connecting the upper and lower ends of a sail respectively to said sail-supporting connection and to said drive member, and said sail-hoisting means to said hoisting-line connection, whereby said hoisting element may be hoisted along said wire into a raised position on said furling-drive element with the upper end of a sail attached to the hoisting element, said elements thereafter coupling the sail to the wire for furling thereon in response to rotation of the wire.

2. A sail hoisting, supporting and furling apparatus as defined in claim 1 in which said furling-drive element is an elongated rod telescoped over and affixed to the upper end portion of said wire, and further including an abutment adjacent the upper end of said rod preventing hoisting of said sleeve beyond said furling-drive element.

3. A sail hoisting, supporting and furling apparatus as defined in claim 1 in which said furling-drive element is of regular hexagonal cross-section, and said through passage has twelve V-shaped grooves, to be coupled to said furling-drive element in the manner of a socket wrench with a moderate amount of angular orientation during such coupling.

4. A sail hoisting, supporting and furling apparatus as defined in claim 1 in which said sail-supporting connection comprises a first bail with legs straddling said sleeve, and pivot means mounting said bail on said hoisting sleeve to pivot about a first axis extending through the longitudinal centerline of said through passage in the lower end portion of each sleeve, said bail normally being inclined downwardly and to one side of said sleeve.

5. A sail hoisting, supporting and furling apparatus as defined in claim 1 in which said hoisting-line connection comprises a second sleeve fitted around the upper end portion of said hoisting sleeve, anti-friction thrust bearing means mounting said second sleeve rotatably and coaxially on said hoisting sleeve for movement along said wire therewith, a second bail with legs straddling said second sleeve, and second pivot means mounting said second bail on said second sleeve to pivot about a second axis extending through the longitudinal centerline of said through passage in the upper end portion of said hoisting sleeve.

6. A sail hoisting, supporting and furling apparatus as defined in claim 1 in which said lower mounting means comprise a roller-furling drum unit having an axle for connection to the boat hull, a drum rotatably mounted on said axle, and means for connecting said drum non-rotatably to the lower end of said wire.

7. A sail hoisting, supporting and furling apparatus as defined in claim 6 in which said lower end has a threaded fitting affixed thereto, the last-mentioned means comprising a rod coaxially affixed to said drum and threadably connected to said threaded fitting.

8. A sail hoisting, supporting and furling apparatus as defined in claim 1 in which said upper mounting means comprise a rod secured to the upper end of said furling-drive element and extending upwardly therefrom to the swivel, and means for suspending said swivel from the mast.

9. A sail hoisting, supporting and furling apparatus as defined in claim 1 in which said means for connecting said upper and lower ends comprise snap fasteners for non-rotatable connection to a sail and to said sail-supporting connection and said drive member.

10. A sail hoisting, supporting and furling apparatus as defined in claim 9 further including snap fasteners for loosely connecting the sail to said wire between said upper and lower ends.

11. In a sail hoisting, supporting and furling apparatus mountable on a sailboat between the hull and the mast thereof, and including an elongated wire having upper and lower end and capable of transmitting torsional force from the lower end to the upper end, upper mounting means for supporting the wire for rotation about its longitudinal axis, and lower mounting means for connecting the lower end rotatably to the hull, the improvement which comprises:

a hoisting element telescoped slidably over said wire with a loose, clearance fit for movement longitudinally along the luff wire, and having means thereon for connection to a sail, said hoisting element having an internal passage of non-circular cross-sectional shape;

and a furling-drive element affixed to said wire in a preselected position and having a non-circular outside surface sized and shaped to fit slidably and snugly into said hoisting element and to couple the latter non-rotatably to said wire, whereby said hoisting element may be hoisted along the wire onto said furling-drive element to raise a sail, and the wire may be rotated to furl the sail around the wire.

12. A sail hoisting, supporting and furling apparatus as defined in claim 1 wherein said hoisting element is a sleeve having a through passage of regular polygonal cross-section, and said furling drive element is a rod affixed to the upper end of said wire as in extension thereof, and having a regular polygonal outside shape engageable non-rotatably in said through passage.

13. A sail hoisting, supporting and furling apparatus as defined in claim 12 in which said rod has a downwardly tapered lower end portion for guiding said sleeve onto said rod.

14. A sail hoisting, supporting and furling apparatus as defined in claim 13 in which said lower end portion has the same polygonal shape as said rod, to position said sleeve angularly on said rod.

15. A sail hoisting, supporting and furling apparatus as defined in claim 12 further including hoisting-line and sail-supporting connections on said hoisting sleeve;

said hoisting-line connection including a second sleeve rotatably mounted around the upper end portion of said hoisting sleeve, and means on said second sleeve for connection to a hoisting line;

said sail-supporting connection comprising a bail straddling said hoisting sleeve below said second sleeve, and means pivoting said bail on said second sleeve to rotate about a first transverse axis.

16. A sail hoisting, supporting and furling apparatus as defined in claim 15 in which said means on said second sleeve for connection to a hoisting line comprise a second bail straddling said second sleeve, and means pivoting said second bail said second sleeve to rotate about a second transverse axis.

17. A sail hoisting, supporting and furling apparatus as defined in claim 16 in which said transverse axes extend through the longitudinal centerline of said through passage and are perpendicular thereto.

18. In a sail hoisting, supporting and furling apparatus mountable on a sailboat between the hull and the mast thereof, and including an elongated wire having upper and lower ends and capable of transmitting torsional force from the lower end to the upper end, upper mounting means for supporting the wire for rotation about its longitudinal axis, and lower mounting means for connecting the lower end rotatably to the hull, the improvement which comprises:

a furling-drive element affixed to said wire in a preselected position along the length of the wire;

a hoisting element supported for movement along the wire and having means thereon for connection to a sail, to hoist the sail along the wire;

coupling means on said elements engageable between said elements as the hoisting element is moved along the wire, and operable to couple the hoisting element to the wire for rotation therewith;

and means for coupling the luff of a sail to said hoisting element and to said lower mounting means for winding up of the sail as said wire is rotated.

* * * * *

UNITED STATES PATENT AND TRADEMARK OFFICE

CERTIFICATE OF CORRECTION

PATENT NO. : 3,958,523

DATED : May 25, 1976

INVENTOR(S) : Tracy S. Holmes and Thomas J. Simms, Jr.

It is certified that error appears in the above-identified patent and that said Letters Patent are hereby corrected as shown below:

Column 3, line 9, "headstray" should be --headstay--.

Column 5, line 60, delete "said-hoisting" and insert therefor --sail-hoisting--.

Column 8, line 26, after the word "bail", insert --on--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*